United States Patent [19]

Bell

[11] Patent Number: 5,031,668

[45] Date of Patent: Jul. 16, 1991

[54] JACQUARD WEAVING MACHINE UTILIZING SELECTIVELY RECIPROCATABLE CONTROL MEMBERS

[75] Inventor: Jack Bell, Bradford, United Kingdom

[73] Assignee: Eltex of Sweden AB, Almhult, Sweden

[21] Appl. No.: 469,437

[22] PCT Filed: Oct. 10, 1988

[86] PCT No.: PCT/SE88/00523

§ 371 Date: Apr. 10, 1990

§ 102(e) Date: Apr. 10, 1990

[87] PCT Pub. No.: WO89/03441

PCT Pub. Date: Apr. 20, 1989

[30] Foreign Application Priority Data

Oct. 10, 1987 [GB] United Kingdom ..... 8723850

[51] Int. Cl.[5] ..... D03C 3/00; D03C 11/00; D03C 13/00

[52] U.S. Cl. ..... 139/76; 139/59; 139/66 R; 139/430

[58] Field of Search ..... 139/67, 70, 76, 59, 139/430, 66 R, 66 A; 66/205

[56] References Cited

U.S. PATENT DOCUMENTS 4,285,217 8/1981 Mista et al. ..... 66/205
4,387,741 6/1983 Palau et al. ..... 139/76
4,433,704 2/1984 Decuq ..... 139/66 R
4,730,642 3/1988 Surkamp et al. ..... 139/76
4,763,697 8/1988 Serturini ..... 139/76

FOREIGN PATENT DOCUMENTS 3524569 1/1987 Fed. Rep. of Germany ..... 139/59

*Primary Examiner*—Andrew M. Falik
*Attorney, Agent, or Firm*—Antonelli, Terry, Stout & Kraus

[57] ABSTRACT

An apparatus for controlling warp threads on weaving machines, particularly suited for control of warp threads on Jacquard type machines, for example selvedge machines. Control members are arranged to control movement of a warp thread and are adapted to be moved in arcuate paths by a reciprocatable member which reciprocates repeatedly. Selectively operable members cooperate with the control members to allow the control members to reciprocate fully with the reciprocatable members or to be held in a position in which the control members either reciprocate less than the reciprocatable members or do not reciprocate at all. The control members have abutting surfaces in different planes which slide relative to each other and which permit the control members to be positioned with the abutting surfaces facing each other with a combined thickness substantially the same as the overall thickness of one of the control members.

7 Claims, 3 Drawing Sheets

JACQUARD WEAVING MACHINE UTILIZING SELECTIVELY RECIPROCATABLE CONTROL MEMBERS

BACKGROUND OF THE INVENTION

The present invention relates to the control of warp threads on weaving machines and in particular, although not exclusively, to the control of warp threads on Jacquard machines, e.g. selvedge machines.

In a known selvedge machine, each warp thread from a shed is threaded through a heald eye secured to a heald wire. The lower end of the wire is attached to one end of a spring which biases the lower end of the cord downwardly. The upper region of the wire passes around a floating pulley, and its end is secured to a fixed mounting. The pulley is connected to, and suspended from, a further floating pulley around which a loop passes. Each end of the loop is connected to a different hook, and the upper region of each hook co-operates with a different griffe bar. In use, the griffe bars alternately reciprocate up and down and, when the warp thread is required to remain in the upper position, the ends of the hooks move up and down with the griffe bars. With such a movement, the pulleys remain in the upper position.

When it is required to lower the warp thread, a needle, co-operating with the hooks, is caused to move, when one of the griffe bars is in the lower position, to push the hook off that griffe bar so that the hook remains in the lower position when the associated griffe bar rises. When this occurs, the pulleys are allowed to fall when the other griffe bar and hook move downwardly, and the spring pulls the wire downwardly to move the warp thread to the lower position. The movement of the needle is controlled by a movable operating card, having appropriate openings.

The griffe bars and hooks are expensive to manufacture and complicated to operate satisfactorily over long periods, as the griffe bars reciprocate in a straight direction, this causing considerable stress on those bars, and the hooks are required to move in two directions, one being vertical as the griffe bars reciprocate and the other being horizontal as the hooks are pushed off the griffe bars. Furthermore, the griffe bars and hooks tend to become worn fairly rapidly as a result of their operating action. An additional disadvantage is the mechanical operation of the needle and card which present further mechanical components liable to wear and break down. As a result of the complexity of operation of the prior machine, only a relatively low operating rate of around 400 revs or cycles per minute is able to be achieved.

SUMMARY OF THE INVENTION

According to one aspect of the present invention, a warp thread control apparatus includes a control member adapted to be moved selectively in an arcuate path. With such an apparatus the movement or otherwise of the control member can be arranged to control whether movement of a warp thread occurs.

The apparatus may include a reciprocatable member with which the control member is capable of moving. The reciprocatable member may be arranged to reciprocate repeatedly, and the control member may be capable of being selectively held in a position in which it does not reciprocate fully (which includes a position in which it does not reciprocate at all) with the reciprocatable member. The control member may be arranged to be held in the position in which it does not reciprocate fully with the reciprocatable member by selectively operable means which are capable of co-operating with the control member.

The apparatus may include a further control member adapted to be moved selectively in an arcuate path. The control member may be connected together by a flexible member. The arcuate paths through which the control members may move may be in a common plane. Both of the control members may be capable of moving with the reciprocatable member. The control members may be capable of being held in different positions from each other in which they do not reciprocate fully with the reciprocatable member.

The control members may be pivotable about a common axis.

The control members may include abutting sufaces which are capable of sliding relative to each other.

According to another aspect of the present invention, a warp thread control apparatus includes a control member capable of being selectively reciprocally moved in a path, with the control member being arranged to be in that path when it is not being reciprocally moved in the path.

According to a further aspect of the present invention, a method of controlling a warp thread comprises selectively moving a control member in an arcuate path.

According to another aspect of the present invention a method of controlling a warp thread comprises selectively reciprocally moving a control member in a path and allowing the control member to remain in that path when it is not being reciprocated. The path may be curved or arcuate.

The present invention includes any combination of the herein defined features, including a method of controlling a warp thread using an apparatus as herein defined.

BRIEF DESCRIPTION OF THE DRAWINGS

The invention may be carried into practice in various ways, but two embodiments will now be described by way of example and with reference to the accompanying drawings in which.

DETAILED DESCRIPTION OF PREFERRED EMBODIMENTS

Figure 1:
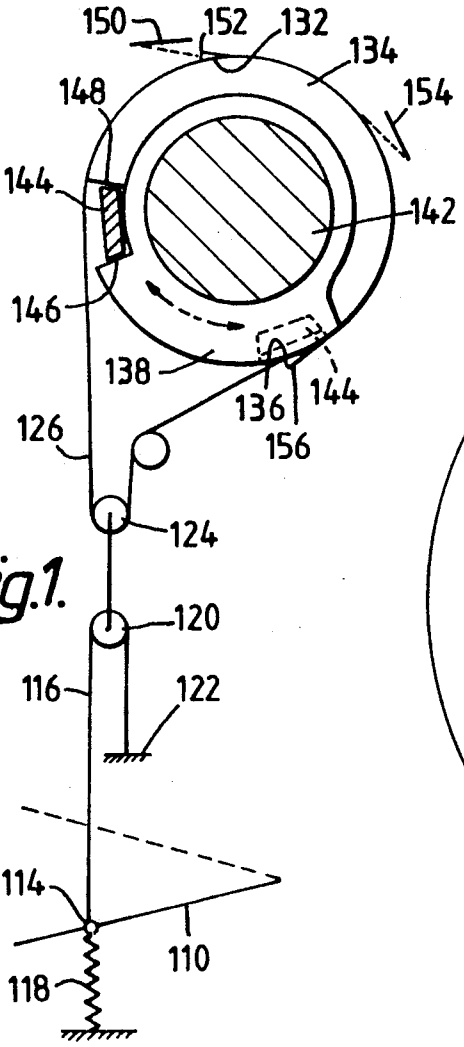
FIG. 1 is a schematic diagram of part of one embodiment of the present invention.

In FIG. 1, the control of one warp thread 110 is shown, but it will be appreciated that, as the machine is a selvedge machine, typically 56 or 64 warp threads at the edge of a cloth are controlled by adjacent mechanisms.

The lower portion of the control illustrated in FIG. 1 corresponds generally to that portion of a known machine in that the warp thread 110 passes through a heald eye 114 attached to a heald wire 116. The lower end of the wire 116 is biased downwardly by a spring 118, and the wire extends upwardly and passes around a floating pulley 120. The wire is fastened to a fixed mounting 122.

A floating pulley 124 is connected to, and suspends the pulley 120 and a loop 126 passes under the pulley 124. One end 132 of the loop is secured to a first disc 134, and the other end 136 of the loop is secured to a second disc 138. Both of the discs 134 and 138 have an inner circular opening 140 (shown in FIGS. 2 and 4) through which an axle 142 passes, that axle being common to the other discs controlling the other warp threads.

In use, when the warp thread 110 is required to remain in the lower position, shown in solid lines, a bar 144 is caused to swing to and fro between the position shown in solid lines and the position shown in chain lines. As the bar 144 moves in an a counterclockwise direction, it bears against a radially extending surface 146 of the second disc 138, causing that disc to pivot in the same direction on the axle 142. At the same time, the tension in the wire 116 exerts a tension in the loop 126 to cause the end 132 of the loop to pull the first disc 134 in a counterclockwise direction, with a radially extending surface 148 of the first disc 134 remaining in contact with the bar 144. When the bar 144 returns in a clockwise direction from the position shown in chain lines, it pushes the first disc 134 back to the position shown, and the second disc 138 follows by being pulled by the end 136 of the loop. During this movement the pulley 124 remains at the same height shown in the figure.

When it is desired to raise the warp thread 110 to the position shown in chain lines, while the bar 144 is in the position shown in solid lines a solenoid (not shown) is briefly actuated to cause a pivotally mounted stop member 150 to move from the position shown in solid lines to the position shown in chain lines. Just after the bar 144 moves in a counterclockwise direction, the first disc 134 is prevented from moving significantly in that direction by a radially extending notch 152 on the disc which engages the stop member 150. At that time the solenoid actuating the stop member can be deenergised, as the stop member 150 is held in place by the notch 152. Accordingly, the bar 144 pushes the second disc 138 in a counterclockwise direction, moving the end 136 of the loop away from the pulley 124 and causing the pulley 124 to be raised, thereby raising the pulley 120, the wire 116, and the warp thread 110.

With the warp thread 110 in the raised position and the bar 144 in the position shown in chain lines, the warp thread can either be allowed to remain in the raised position during the following clockwise movement of the bar, or it can be allowed to return to the lowered position.

In order to return the warp thread 110 to the lower position, the bar 144 returns in a clockwise direction, with the second disc 138 following and the pulleys 124 and 120 being lowered. Towards the end of the clockwise movement of the bar 144, the bar engages with the surface 148 of the first disc 134 to cause it to pivot in a clockwise direction until the notch 152 just clears the stop member 150. The stop member can then either be allowed to return to the position shown in solid lines or the solenoid can be actuated to retain the stop in the position shown in chain lines such that it will again be engaged by the notch 152 upon return of the first disc 134 in a counterclockwise direction.

In order to retain the warp thread 110 in the raised position when the bar 144 is in the position shown in chain lines, a solenoid (not shown) is actuated to cause a stop member 154 to move into the position shown in chain lines where the stop member 154 will be engaged by a notch 156 formed on the second disc 138 just after the second disc starts to move back in a clockwise direction with the bar 144. As soon as the stop member 154 is engaged by the notch 156, the solenoid causing the stop member 134 to move can be deengerised.

It can be seen that at the end of each successive clockwise and counterclockwise movement of the bar 144, the warp thread 110 can be in the raised or lowered position in dependence upon the actuation of the solenoids. The timing of the actuation of the solenoids can be controlled in any desired way, for instance by a computer control, and the rate of control may comprise 600 or more possible changes in the position of the warp thread 110 per minute.

Figure 3:
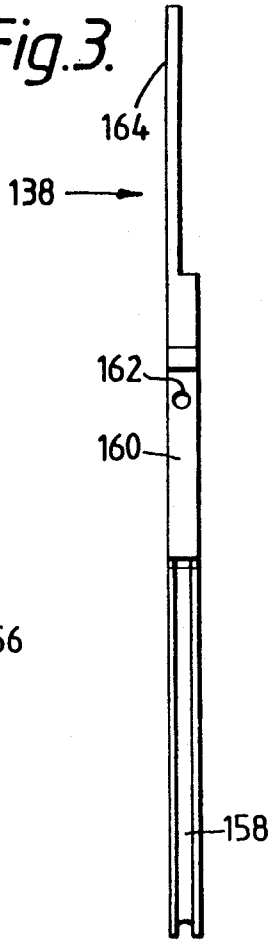
FIGS. 2 and 3 are, respectively, a side view and an end view of one component shown in FIG. 1.
Figure 2:
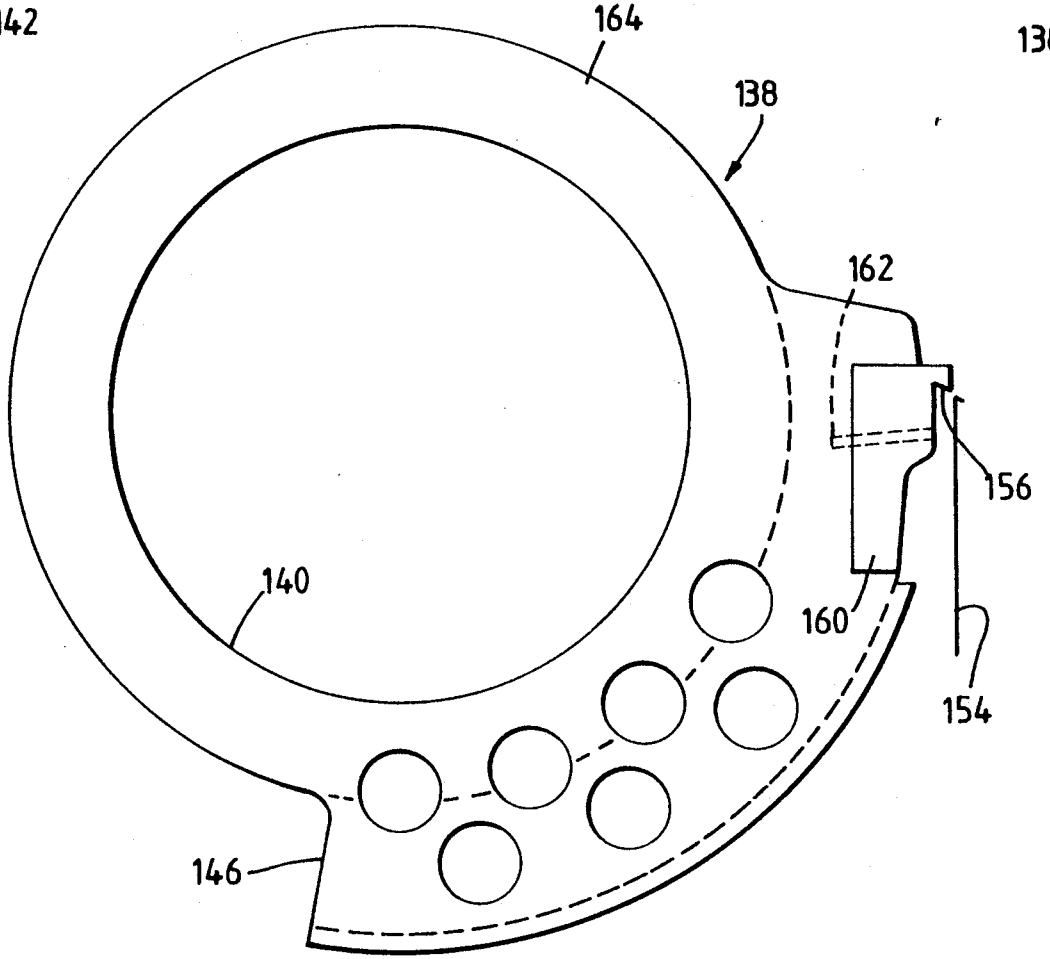
Figure 5:
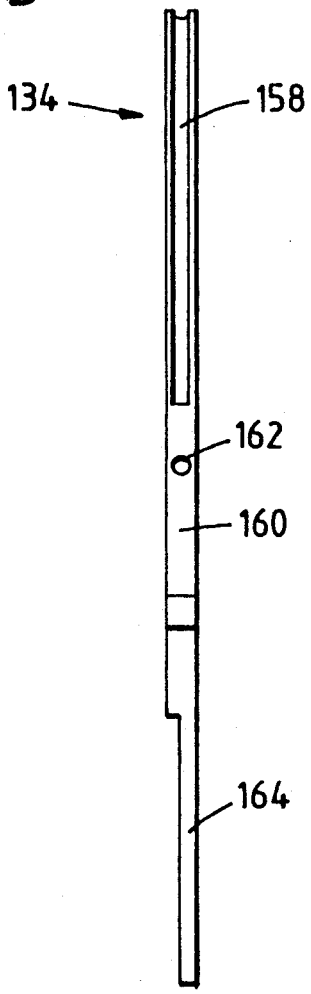
FIGS. 4 and 5 are, respectively, a side view and an end view of another component shown in FIG. 1.
Figure 4:
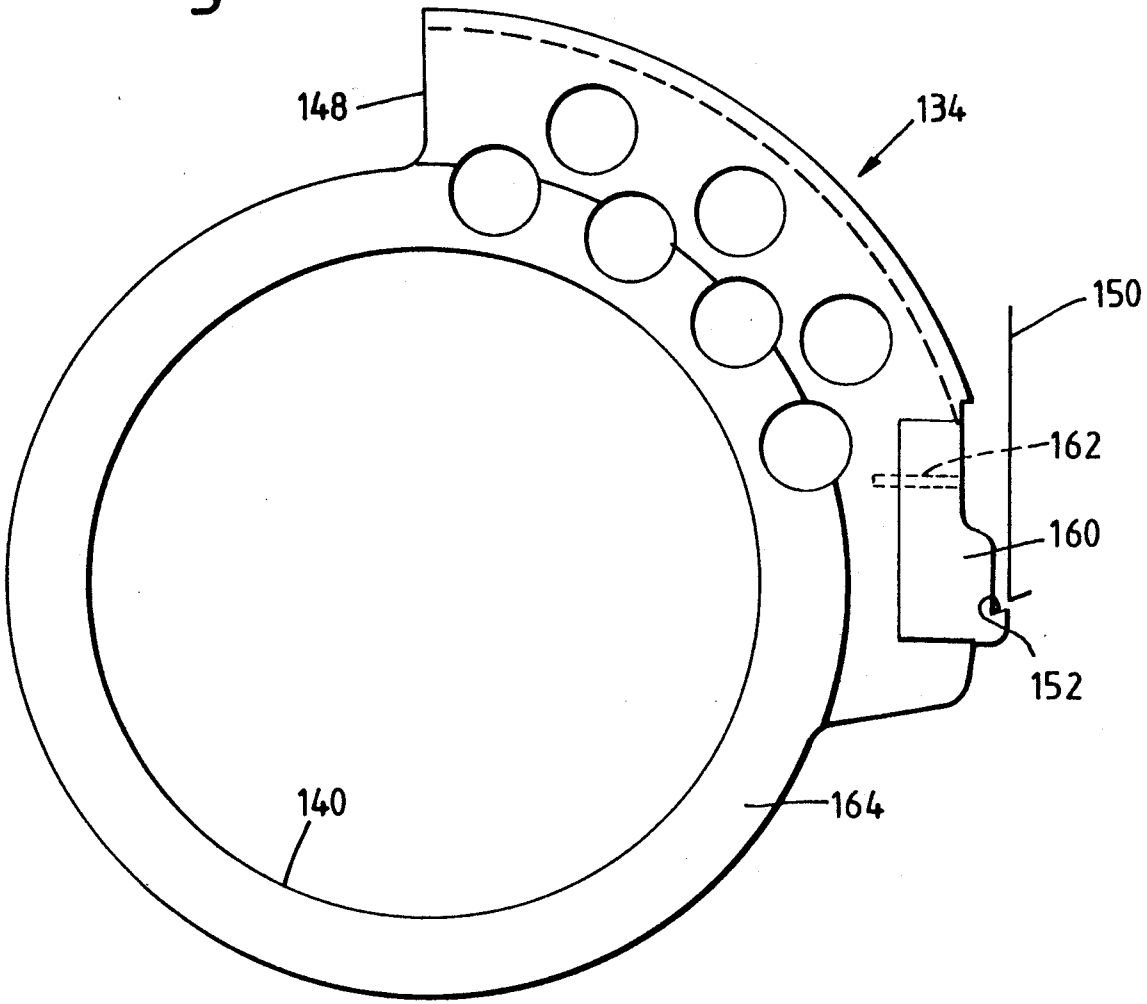

The first and second discs 134, 138 shown respectively in FIGS. 2 and 3 and in FIGS. 4 and 5 each include a peripherally extending groove 158 within which the loop 126 may be located and from which it may extend. The ends of the loop are secured to a screw which passes through a threaded passage 162 in an insert 160. Alternative methods of such attachments may be used. The insert 160 provides a hard register for the stops and includes the notch 152 or 156. The insert 160 is secured to the disc.

The discs 134, 138 are each provided with a flange 164 which is half the thickness of the outer portion of the discs provided with the groove 158 such that, when the discs are brought together, the flanges 164 abut one another and the grooves 158 on the discs are in the same circumferential plane. In use, the abutting surfaces of the flanges 164 are arranged to slide over each other.

In an alternative mode of operation, the stop members 150 and 154 are arranged to be in the positions shown in chain lines in FIG. 1, with the solenoids being arranged to be actuated to move the stops clear of the notches 152 and 156 when the bar 144 moves the notches slightly away from the stop members. Consequently, when the solenoids are not actuated, the bar 144 reciprocates between the raidal surfaces 148 and 146 on the discs, and only engages those surfaces towards the very end of its movement in one or other direction, and the warp thread remains in the position shown in chain lines. In order to allow the warp thread to move to the lower position shown in solid lines, the appropriate solenoid is actuated to allow one or other of the radially extending surfaces 148 or 146 to follow the bar 144 throughout its reciprocal movement.

Figure 6:
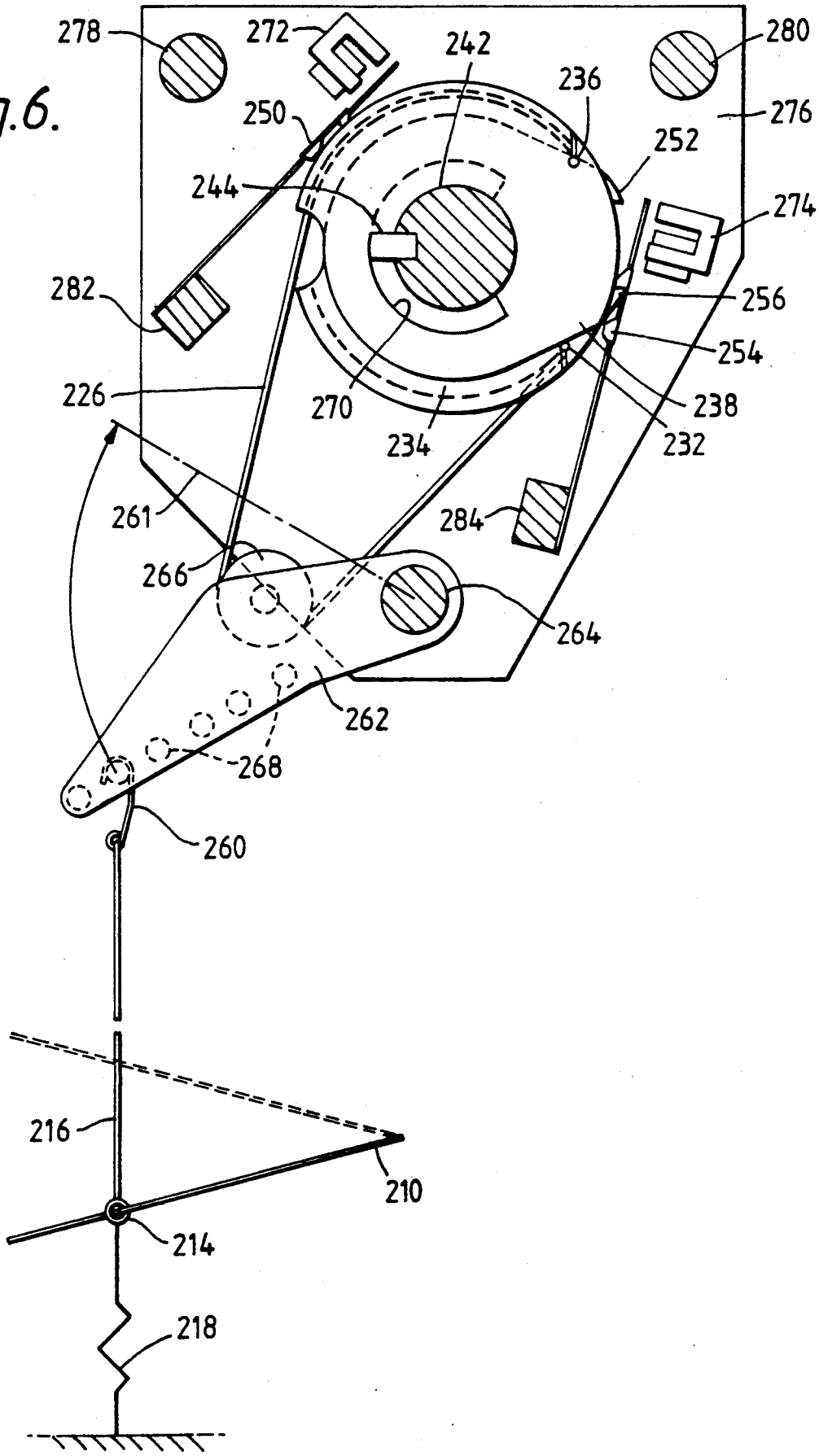
FIG. 6 is a schematic diagram of part of an other embodiment of the present invention.

In the embodiment as shown in FIG. 6, the position of one warp thread 210 is controlled, but it is appreciated that any number of warp threads may be controlled by adjacent mechanisms.

The warp thread 210 passes through a heald eye 214 attached to a heald wire 216. The lower end of the wire 216 is biased downwardly by a spring 218, and the wire extends upwardly to a hook 260 securing the end of the wire 216 to an arm 262. The arm 262 is pivotable on an axle 264 parallel to the axle 242 for the discs 234 and 238. The arm 262 may include two side plates between which is provided a rotatable wheel 266 and several bosses 268 for the hook 260. With the hook 260 on the boss 268 closest to the axle 264 the lift of the warp thread 210 will be minimum, e.g. 50 mm, and with the hook 260 on the boss 268 at the tip of the arm 262 the lift of the warp thread 210 will be maximum, e.g. 125 mm.

The discs 234, 238 are of the same type as the discs shown respectively in FIGS. 2, 3 and 4, 5 except that the opening 240 for the axle 242 is expanded with an area 270 allowing free movement of the bar 244 within a sector of the disc. The bar 244 is in the form of a fin on the axle 242. The fin 244 extends along the axle 242 and is secured to the same and is reciprocatable repeatedly with the axle 242 in order to pivot the discs counterclockwise and clockwise. Also, the ends of the wire 226 are secured in another suitable manner.

Depending on the position of the stop members 250 and 254 controlled by the solenoids 272 and 274, respectively, the warp thread 210 will remain in the lower position, be raised to the upper position, be kept in the upper position or alternately raised and lowered during counterclockwise and clockwise movement repeatedly of the axle 242 and the fin 244. If the stop member 254 engages the notch 256, when the axle 242 and the fin 244 pivot counterclockwise, the fin 244 engages the disc 234 to pivot the same in a counterclockwise direction.

As the disc 238 is hooked when the stop member 254 engages the notch 256 and the area 270 allows free movement of the fin 244, the disc 238 will not move, and the loop 226 will be shortened, causing the arm 262 to pivot clockwise around the axle 264 to the upper position shown by a broken line 261. In this position of the disc 234, the notch 252 is in engagement with the stop member 250. If the notches 252 and 256 remain engaged with the stop members 250 and 254, the arm 262 and the warp thread 210 will remain in the upper position during repeated reciprocation of the axle 242 with the fin 244. After disengagement of either notch and stop member, the arm 262 and the warp thread 210 will be lowered and remain lowered if both notches and stop members remain disengaged; otherwise it will be raised immediately to the upper position.

As in the previously described embodiment, the solenoids 272, 274 may be actuated to either disengage or engage as might be preferred.

The axles 242 and 264 extend between a frame plate 276 at each side of the control apparatus. Also frame rods 278 and 280 extend between the frame plates 276. The stop members 250 and 254 are mounted on rods 282 and 284 extending between the frame plates. Also the solenoids 272, 274 are mounted on rods which are not shown but which preferably extend between the frame plates. The arms between the rods 282 and 284 and the stop members 250, 254 may be made of any suitable material and arranged to be spring stressed against either the discs 234, 238 or the solenoids 272, 274, depending on the manner chosen for the actuation of the solenoids 272, 274.

One of the advantages with this embodiment is the possibility to reducing the number of parts, as the pulley 120 may be omitted, and the use of the hook 260 and the arm 262 allows the lifts to be changed. Low lifts allow higher speed, and the minimum lift may allow a speed of 1000 revs or cycles per minute, while the speed at the maximum lift will be reduced to 600 revs or cycles per minute. Naturally, the speed is dependent on the weaving machine itself also.

I claim:

1. An apparatus for controlling warp threads on weaving machines comprising:

first and second control members;

a reciprocatable member for reciprocating in an arcuate path;

selectively operable means adapted to selectively assume a first condition, in which the control members fully reciprocate with the reciprocatable member, or a second condition, in which the control members are held in different positions and do not reciprocate fully, or do not reciprocate at all, with the reciprocatable member; and flexible means connecting the first and second control members together and responsive to reciprocation of the control members for controlling positioning of a warp thread.

2. An apparatus as claimed in claim 1, in which the reciprocatable member includes means for reciprocating the control members about a common axis.

3. An apparatus as claimed in claim 2, wherein the control members are provided with abutting surfaces adapted for sliding relative to each other.

4. An apparatus as claimed in claim 3, wherein the abutting surfaces of the control members are in different planes, whereby the abutting surface of the first control member is adapted to slide relative to the abutting surface of the second control member, so that the two control members are positioned with the abutting surfaces facing each other and have a thickness substantially the same as the thickness of one of the control members.

5. An apparatus as claimed in claim 1, wherein the flexible means includes a pivotable arm; a spring loaded wire adapted for connection to the warp thread; and connecting means for connecting the wire to the pivotable arm to control positioning of the warp thread.

6. An apparatus as claimed in claim 5, wherein said connecting means comprises means for connecting the spring loaded wire to the pivotable arm in different positions along the length of the pivotable arm, so that the extent to which the wire is moved may be changed within a range determined by the length of the pivotable arm and the angle through which the pivotable arm is moved by the flexible member.

7. An apparatus as claimed in claim 1, wherein the control members include an axle; the reciprocatable member includes a fin on the axle; and each of the control members has an opening for the axle with an area within which the fin is moveable without influencing that control member.

* * * * *